US007192152B1

(12) United States Patent
Hesse

(10) Patent No.: US 7,192,152 B1
(45) Date of Patent: Mar. 20, 2007

(54) ACTUATED BATTERY OPERATED LIGHTED GARMENT

(76) Inventor: Martin K. Hesse, 18995 SE. Homewood Ave., Tequesta, FL (US) 33469

( * ) Notice: Subject to any disclaimer, the term of this patent is extended or adjusted under 35 U.S.C. 154(b) by 45 days.

(21) Appl. No.: 10/922,250

(22) Filed: Aug. 19, 2004

(51) Int. Cl.
*F21V 21/00* (2006.01)

(52) U.S. Cl. ..... 362/108; 362/103; 273/317.5; 2/905; 446/26; 446/219; 340/323 R; 340/326

(58) Field of Classification Search ..... 362/108, 362/103, 84, 276; 273/317.5, 55 R, 502, 273/312; 446/26, 219; 473/415, 464, 499; 700/90, 91; 340/323 R, 323–329; 2/905
See application file for complete search history.

(56) References Cited

U.S. PATENT DOCUMENTS 6,554,445 B1 * 4/2003 Jacoby ..... 362/108
6,945,663 B2 * 9/2005 Chien ..... 362/84
2005/0026688 A1 * 2/2005 Goeben ..... 463/36
2005/0073834 A1 * 4/2005 Langley et al. ..... 362/108

FOREIGN PATENT DOCUMENTS

GB 2402321 A * 12/2004

* cited by examiner

*Primary Examiner*—Renee Luebke
*Assistant Examiner*—Mary Zettl
(74) *Attorney, Agent, or Firm*—Norman Friedland

(57) ABSTRACT

An outer garment or vestment comprising a front panel and rear panel that includes an electrical circuit of neon wire, a battery operated power pack and toggle switch so as to be illuminated to allow play, such as touch football, tag and the like, in the darkness where the neon wire is mounted in a lens on the rear panel with a configuration defining a focal point such as a spiral shape and is operatively connected to the toggle switch so that depressing the lens causes the illuminated neon wire to be turned off and a portion of the neon wire mounted on the front panel and configured to designate each of the sides of the players.

9 Claims, 3 Drawing Sheets

ACTUATED BATTERY OPERATED LIGHTED GARMENT

FEDERALLY SPONSORED RESEARCH

None

CROSS REFERENCES

None

TECHNICAL FIELD

This invention relates to a garment or vestment that fits over the torso of the wearer that includes a battery operated control for illuminating lighted indicia on the garment and particular to an actuator that is touched by another to actuate the lights to either turn them to off or to on or to flash.

BACKGROUND OF THE INVENTION

This invention is intended for use in sports activity that is played in the night time. Not to say that the concept cannot be used for other purposes as will become evident from the description to follow. As is known, people, particularly young children, enjoy playing games in the evening when it is dark, and an example of such a game is "touch football". In this game sides are chosen and a ball of sorts is used to play where each side has the opportunity to advance the ball toward the opponents goal post. It is also well known that there are balls, such as footballs, that are battery operated that light up so that they are seen in the dark. This invention is to allow persons to play sports similar to touch football where an outer garment or vestment is worn by each of the players and is battery operated. A neon string of wire is attached to the garment so that on one side a logo indicating one side is illuminated and a button on the opposite side is mounted and it likewise is illuminated. A control is attached to the garment and a switch is mounted adjacent to the button. The opposing side touches the button to indicate that that person has been tagged and in the case of touch football, that that person is caught and ends the play. While, one method, is to darken the illuminated indicia by a touch of the button or to cause it to go into a flashing mode, all of which are actuated by a switch operatively connected to the button and the other method is to do the same and include an audio producing device that would create a sound in addition to the mode of the neon wire. Obviously, in sports that have two (2) or more sides or different teams, the indicia for each of the teams will be different so that each team will be distinguishable.

It is quite evident from the above paragraph that this invention can have utility in environments where the natural or created lighting is sufficiently dim so that the lights on the jersey is illuminated sufficiently to be discernable. For example this invention envision this type of garment with the ability to touch a button to change its characteristics to say on, off or intermittent, and to even include some type of noise producing device can be used in addition to the outside environment, like beaches and parks and the like it can be used in inside environments such as skating rinks, gyms, etc. and would have an obvious need in locations in the world where the duration of sunlight is at a minimum.

This invention contemplates that the vestment can be readily cleaned as say, by washing, by mounting the battery power pack to be removable and selecting material that has a propensity of being washed. Another concern of this invention is that the material used cannot be harmful to the wearer such that if falling by accident the button and power pack is isolated to assure that they do not cause harm to the wearer. And additionally, the vestment must be easy to don and doff and maintain.

SUMMARY OF THE INVENTION

The object of this invention is to provide a battery operated illuminated garment or vestment that is actuated to different operated modes by a touch of a button attached to the garment and operatively connected to an electrical switch.

A feature of this invention is to provide an illuminated garment comprising a battery powered power pack operatively connected to a toggle switch that interconnects the power pack to a neon wire to illuminate the same and including a lens attached to the face of the garment that covers a portion of the neon wire and acts a button to actuate the toggle switch. The neon wire is also attached to the front of the garment to designate the team of a player.

Another object of this invention is to provide a garment that includes visible neon wire that is illuminated so as to allow one to play quasi-football in the darkness and to include a touchable button to control the illumination of the neon wire.

A feature on this invention is to provide an illuminated garment that is characterized as relatively inexpensive to fabricate, easy to maintain and clean and provides protection against injury to the wearer.

The foregoing and other features of the present invention will become more apparent from the following description and accompanying drawings.

Figure 1:
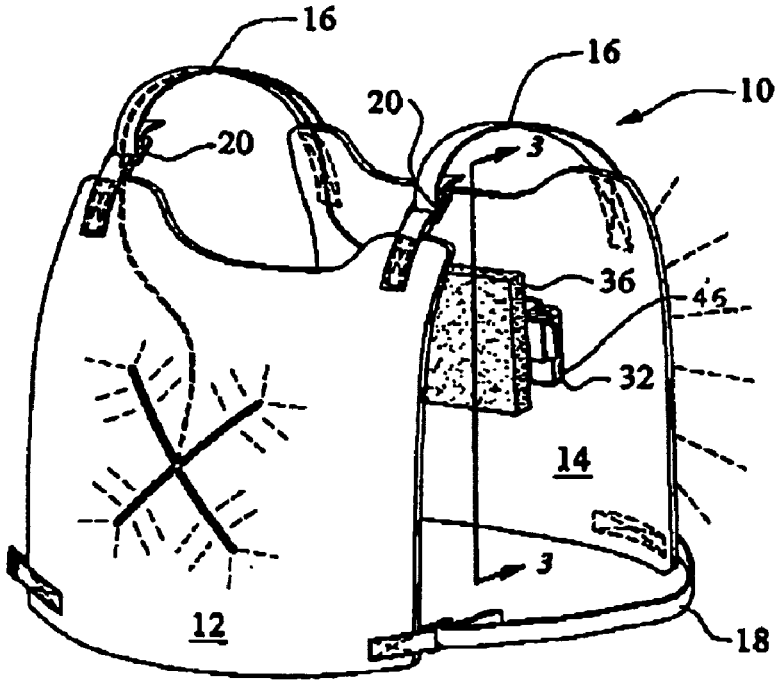
FIG. 1 is a perspective view illustrating the present invention.
Figure 2:
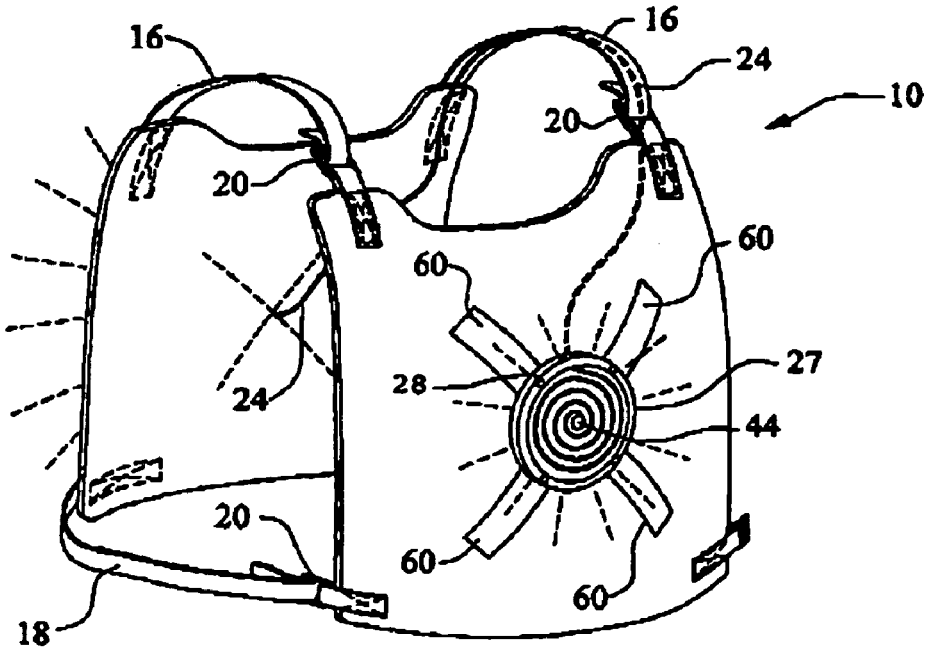
FIG. 2 is a perspective view identical to the embodiment depicted in FIG. 1 illustrating the back side of the garment of the present invention.
Figure 3:
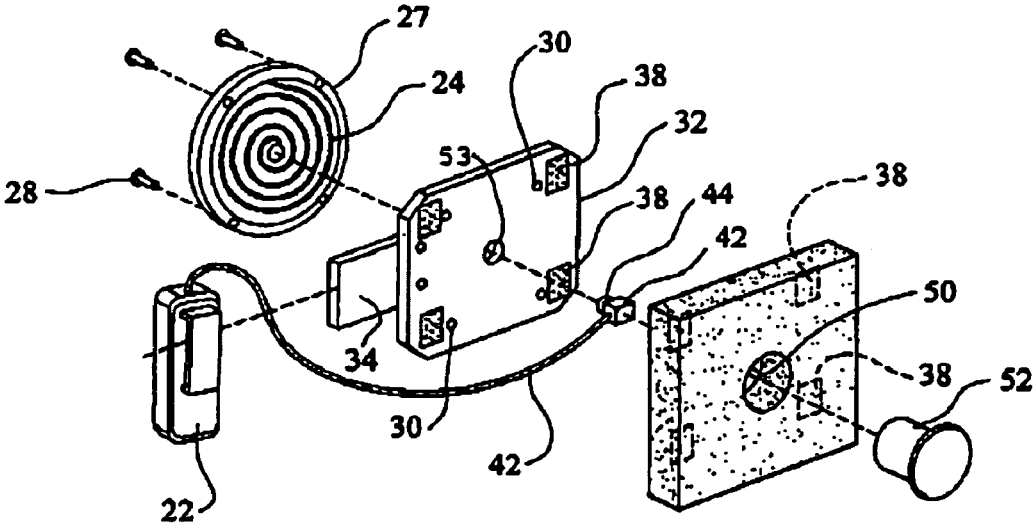
FIG. 3 is an exploded view in perspective illustrating the details of the button and control mechanism of the present invention.

These figures merely serve to further clarify and illustrate the present invention and are not intended to limit the scope thereof.

DETAILED DESCRIPTION OF THE INVENTION

While the invention is disclosed in its preferred embodiment as an overgarment or vestment that is utilized by players in a quasi-football game, it is to be understood that this invention has application for other activities, including both competitive sports or individual sports. While the push button is ideal in a game where one of the players is tagged to discern a condition of the game, it is well within the scope of this invention where the present invention could be used as a garment for an individual utilizing it for situations where darkness is present, as for example, in running, or hunting or fishing. Suffice it to say, the garment is essentially efficacious where it is desirable to provi de a lighted garment that includes a push button to illuminate or stop the illumination or to provide intermittent lighting (flash) as the situation demands. Also, within the scope of this invention, the button can also be used actuate the system to change the illumination, it can also include a device that would produce noise, so that both visual and noise conditions could be utilized in the game being played.

As best seen in FIGS. 1–4, the invention comprises an outer garment generally illustrated by reference numeral 10 having a front panel 12 and a rear panel 14, where the front panel is in reference to the body of the wearer. (Like reference numerals used in all the Figs, designate like parts) The material of the panels in the preferred embodiment is a plastic material, such as neoprene, that is characterized as light weight and being capable of absorbing energy so as to protect the wearer from injury. (A ⅛ inch thick vented padding utilized in gymnasiums can be utilized) The panels 12 and 14 are joined together by a pair of adjustable straps 16 that are attached to the upper portion of the garment 10 so as to fit over the shoulder of the wearer and another pair of adjustable straps 18 that are mounted on the lower portion of the panels 12 and 14. One end of each of the adjustable straps 16 and 18 and are sewn directly onto the panels to secure them in place. A suitable commercially available VELCRO® fasteners or buckles 20 are utilized to adjust the straps to fit the wearer.

The invention essentially consists of a power pack 22, neon wires 24, a toggle switch 40 and the arrangement of these components. As noted in FIG. 3 the neon wire is helically wound (obviously, shapes other than spiral, can equally be employed, but should define a focal point) on the back panel 14 and fits into a translucent plastic cover or lens 27 that is mounted on the back panel 12 and visible from the outside. A plurality of grommets 28 made, say, from aluminum, extend through openings formed in the plastic cover 27 through the garment and through complementary openings 30 formed in the support member 32 to support the plastic cover 27 to the face of the back panel 12. The support member 32 is planar in shape and is made from any suitable commercially available plastic hard material and includes a side projection 34 mounted on or made integral thereto projects from one end of member 32 and serves to support the power pack 22, which will be described in detail herein below.

A planar rectangular shaped pad 36 made from a soft plastic, energy absorbing material, such as neoprene, say ¼ inch thick, is removably attached to the back surface of the support member 32 by a plurality of suitable, commercially available Velcro adhesive pieces of tape 38 that serve to hold the pad 36 to the support member 32. The purpose of pad 36 is to absorb the energy from the force being used by the opponent or person that presses the button 44 of the toggle switch 40 which will be described in detail in the description to follow.

A suitable power pack 22, such as the commercially available power pack identified as "COOLNEON, is available from coolneon.com company and accessible over the Internet (telephone number 510.547.587). The unit includes a cavity supporting AA batteries and the electrical circuitry to power the system so as to illuminate the neon wire 24. An enclosure for the battery cavity is provided. The power pack 22 includes an on/off and flashing switch so that when actuated it supplies power for the neon wire to be illuminated. A clip extending from the back surface of the power pack clips onto the projection 34 to secure it in place and facilitates the removal thereof when it is desirable to replace, insert batteries or wash the garment.

A suitable commercially available toggle switch 40 is wired to the power pack 22 via the wire 42 to supply electrical power thereto is mounted in aperture 53 and includes a toggle button 44 that extends through the opening 46 formed in the member 32 through an opening formed in the back panel 12 and into the plastic cover 27 and abuts against the back surface thereof. The plastic cover or lens 26 which preferably is made from plexiglass is sufficiently resilient so that pushing against the front face of the plastic cover 27 will position the toggle button to actuate the switch 40. This, of course, will connect or disconnect the power pack to and from the neon wire to illuminate or de-illuminate the neon wire. The toggle switch may be any suitably commercially available toggle switch, say a push-on-push (2-way) soft feel 3 AA=125 VAC switch, or could be a 3-way switch so that on, off and intermittent can be actuated.

Figure 4:
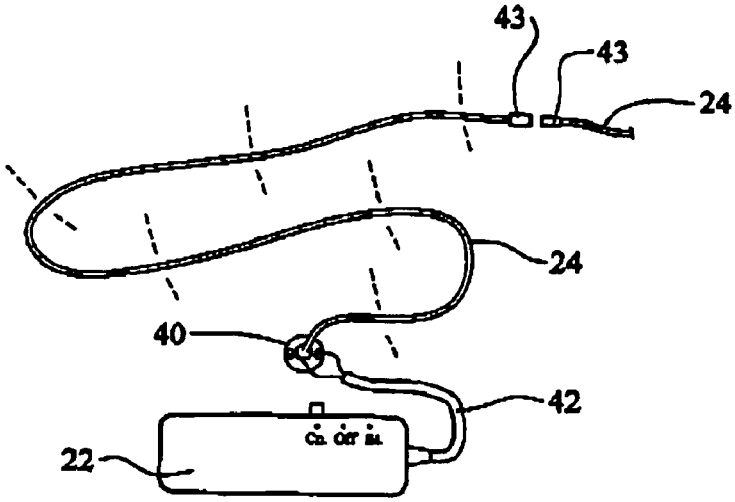
FIG. 4 is an electrical circuit diagram illustrating the power pack and the electrical connections for igniting the lights of this invention.

An access hole 50 is formed in the pad 36 allowing one to gain access to the switch 40. A plug 52 may be utilized to enclose the access hole 50. As best seen in FIG. 4 the power pack is connected to the switch 40 by the positive and negative lead wires of the wire connection 42 which are suitably attached, say by solder. Of course, to gain access to this connection the plug can be removed from the access hole 50.

Figure 5:
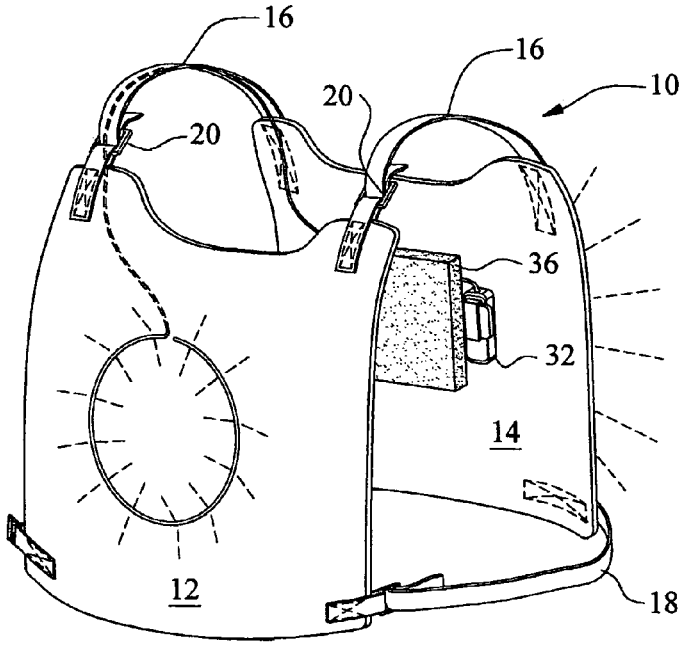
FIG. 5 is a perspective view of another embodiment of this invention illustrating an assembly identical to the embodiment of FIG. 1 with a different configuration to indicate another player when employed in a game.

The front panel 12 includes a configuration of neon wires 24 that extend from the spiral shape in the plastic cover 27 over one of the straps 16 and along the outer surface of the front panel 12. While any shape of the configuration of these wires can be made, in this instance, an "X" shape is utilized to designate one side of a team. As shown in FIG. 5 the neon wire 24 is configured in an "O" shape to designate the opposite side of the team members. It will be noted in FIG. 2 that indicia 60 shaped in the form of an "X" extends from the peripheral edges of the plastic cover 27 on the back panel 14 which conforms to the shape of the neon wire on the front panel 12 to easily identify players on each team. This indicia can be marked directly on the face of the panels or can be made from other material that is attached to the face of the panels. Obviously, any other designations can be used as is desired by the users thereof.

The neon wire is available in different colors giving one the option of using different colors for the players of the different teams. These wires are commercially available and consists of electro-luminescent fiber that has a center wire coated with a powdery white phosphate flanked by two fine redial wires, which in turn is encased in a vinyl coated outer sheath. A male and female connection 43 is mounted on the ends of the neon wire at a location that is convenient for removal of the battery pack 22.

Figure 6:
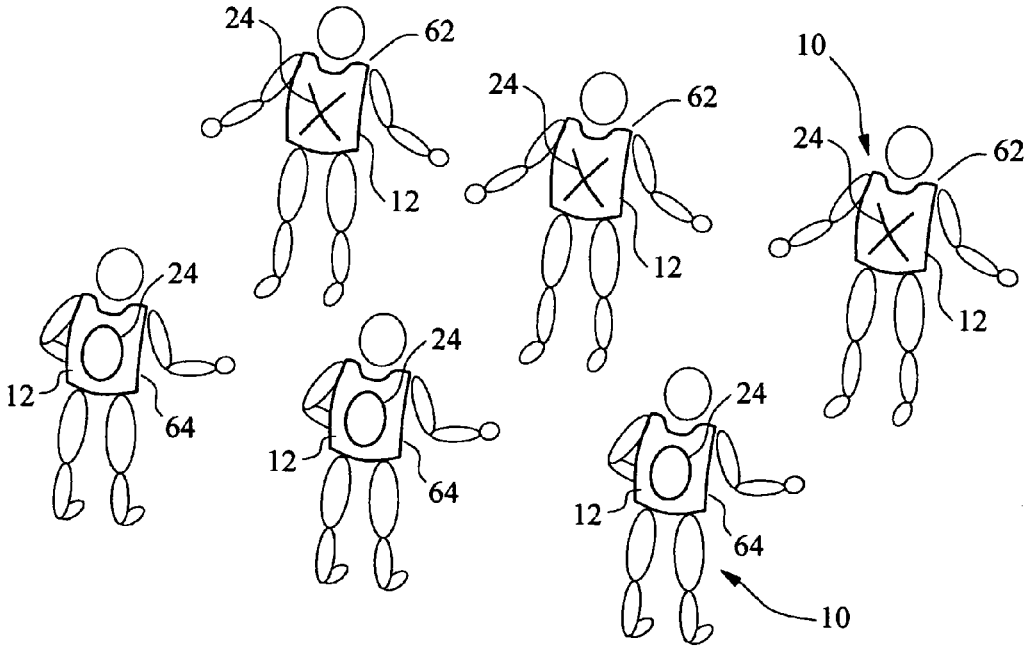
FIG. 6 is a schematic illustration of a group of players utilizing the present invention where the opposite sides of the game are depicted.

FIG. 6 illustrated the alignment of players, say in a quasi-football game, where one side 62 is identified with an "X" and the other side 64 is identified with an "O". A commercially available illuminated football could be used and the game is played where the objective is to catch the person holding the ball, rather than by tackling, as is done in tackle football. In accordance with this invention, the person on the opposite team touches the plastic cover or lens 27, which, in turn, translates the button 44 to actuate the system to the off condition or to a flashing condition. Obviously, because the neon wire is illuminated and well seen in the dark, the game is easily played in the darkness or nighttime and when the button is pressed the condition of the neon lights assures that the person who otherwise would be tackled is caught. Hence, in the game, the players on one side center the ball to one of its players who, in turn, either runs, hands it off to another player, or passes the football to advance the ball toward the goal posts or goal (not shown). The objective of the players of the opposite side is to catch the player with the ball and stop movement. This, of course, is done by touching the lens 27 which, in turn, positions the button 44 to actuate the toggle switch 40 and electrically break the circuit so that electricity form the power pack 22 is disconnected from the neon wires 24. While one of the main purposes of this invention is to allow the playing of quasi-football in the evening so that it is particularly available to children, it is of course, within the scope of this invention that the illuminated garment of this invention can be employed for other activities.

Although this invention has been shown and described with respect to detailed embodiments thereof, it will be appreciated and understood by those skilled in the art that various changes in form and detail thereof may be made without departing from the spirit and scope of the disclosed invention.

The invention claimed is:

1. A vestment intended for outerwear that is visible in the darkness, comprising a front panel having a front surface and a rear surface and a back panel having a front surface and a back surface interconnected to fit over a shoulder of a wearer where the front panel rests in front of the torso of the wearer and the back panel rests in front of the back of the wearer, a battery operated power pack, a lens attached to the front surface of said back panel, a backing member on the back surface of said back panel in alignment with said lens, said lens comprising a plastic flexible member defining a cavity, a neon wire fitted into said cavity and configured to define a focal point, a toggle switch mounted on said back panel having a button extending into said lens and movable by depressing said lens, said neon wire operatively connected to said toggle switch and said toggle switch being operatively connected to said power pack to illuminate said neon wire, said button being movable upon pushing on said lens to actuate said toggle switch and shut-off the illumination of said neon wire, battery means for supplying power to said power pack, whereby the illumination of the neon wire is turned on and off by the depressing of said lens to actuate said toggle so as to control the illumination of said focal point.

2. A vestment intended for outerwear that is visible in the darkness as claimed in claim 1 including said neon wire extending over the front surface of said front panel configured in a given configuration and operatively connected to said toggle switch whereby said configuration is illuminated and not illuminated upon the depressing of said lens.

3. A vestment intended for outerwear that is visible in the darkness as claimed in claim 2 wherein said neon wire in said lens is configured in a spiral shape.

4. A vestment intended for outerwear that is visible in the darkness as claimed in claim 3 including a pad removably mounted on the back surface of said backing member to absorb the force occasioned by the pushing on said lens to actuate said toggle switch.

5. A vestment intended for outerwear that is visible in the darkness as claimed in claim 4 wherein said toggle switch is mounted in an aperture formed in said backing member, a negative wire and positive wire supported in a sheath connected to said power pack and said negative wire and said positive wire connected to said toggle switch and accessible through said aperture and another aperture formed in said pad.

6. A vestment intended for outerwear that is visible in the darkness as claimed in claim 5 wherein said power pack includes a switch for turning on and off the power provided by said power pack and actuating a circuitry in said power pack to cause said neon to be intermittently flashed on and off.

7. A vestment intended for outerwear that is visible in the darkness as claimed in claim 5 including indicia on said front panel and said back panel to provide a predetermined identification of the wearer of said vestment.

8. The method of playing an activity in the darkness for at least two players constituting different sides and each side having the opportunity to change sides and providing an illuminated vestment and a button and control to control the illumination of said vestment comprising the steps of:

I.) Providing a configuration of illuminated neon wire in said button accessible on both of the players;

ii.) Providing a configuration of illuminated neon wire on the front of said vestment to identify each of said players;

iii.) depressing the button provided in step I.) by one of said players to actuate said control and turn the illumination off so that each side is changed; and iv.) restarting the activity by depressing the button to turn the illumination on.

9. The method of playing a game of quasi-football in darkness having players on two different side where a ball is given to one of the players so as to advance the ball to the goal of one side and the other side tries to stop the player with the ball before reaching the goal, and the other side alternately attempts to move the ball to the goal of the other side comprising the steps of:

I.) providing an illuminated outer vestment having a front panel and a rear panel for each of the players with neon wire configured on the front panel a design to designate that side and neon wire of the front panel of the other players with a different design to designate the other side;

ii.) providing a power pack for supplying power to illuminate the neon wire, and a toggle switch for turning on and off the illumination and a flexible lens supporting neon wire to define an illuminated focal point being operatively connected to said toggle switch;

iii.) turning off said illumination by actuating the toggle switch when a player from one side depresses the lens of the player on the other side.

* * * * *